US007421818B2

(12) United States Patent
Houde-Walter

(10) Patent No.: US 7,421,818 B2
(45) Date of Patent: Sep. 9, 2008

(54) FIREARM MOUNT WITH EMBEDDED LASER SIGHT

(75) Inventor: William R. Houde-Walter, Rush, NY (US)

(73) Assignee: LaserMax, Inc., Rochester, NY (US)

( * ) Notice: Subject to any disclaimer, the term of this patent is extended or adjusted under 35 U.S.C. 154(b) by 160 days.

(21) Appl. No.: 11/307,385

(22) Filed: Feb. 4, 2006

(65) Prior Publication Data

US 2007/0180752 A1 Aug. 9, 2007

(51) Int. Cl.
*F41G 1/34* (2006.01)
*F41G 11/00* (2006.01)

(52) U.S. Cl. ..... 42/146; 42/115; 42/148

(58) Field of Classification Search ..... 42/114, 42/115, 117, 146, 148
See application file for complete search history.

(56) References Cited

U.S. PATENT DOCUMENTS

| | | | | | |
|---|---|---|---|---|---|
| 4,415,225 | A | | 11/1983 | Benton et al. | |
| 4,756,733 | A | | 7/1988 | Houde-Walter et al. | |
| 4,934,086 | A | | 6/1990 | Houde-Walter | |
| 4,939,863 | A | * | 7/1990 | Alexander et al. | 42/115 |
| 5,107,612 | A | * | 4/1992 | Bechtel | 42/115 |
| 5,253,443 | A | * | 10/1993 | Baikrich | 42/115 |
| 5,351,429 | A | * | 10/1994 | Ford | 42/115 |
| 5,375,362 | A | | 12/1994 | McGarry et al. | |
| 5,408,778 | A | * | 4/1995 | Goodwin et al. | 42/137 |
| 5,509,226 | A | | 4/1996 | Houde-Walter | |
| 5,515,636 | A | | 5/1996 | McGarry et al. | |
| 5,531,040 | A | * | 7/1996 | Moore | 42/115 |
| 5,584,137 | A | | 12/1996 | Teetzel | |
| 5,617,444 | A | | 4/1997 | Houde-Walter | |
| 5,669,174 | A | * | 9/1997 | Teetzel | 42/115 |
| 5,694,713 | A | * | 12/1997 | Paldino | 42/115 |
| 5,761,235 | A | | 6/1998 | Houde-Walter | |
| 6,025,908 | A | | 2/2000 | Houde-Walter | |
| 6,363,648 | B1 | * | 4/2002 | Kranich et al. | 42/117 |
| 6,366,349 | B1 | | 4/2002 | Houde-Walter | |
| 6,378,237 | B1 | * | 4/2002 | Matthews et al. | 42/124 |
| 6,574,901 | B1 | * | 6/2003 | Solinsky et al. | 42/146 |
| 6,591,536 | B2 | | 7/2003 | Houde-Walter et al. | |

OTHER PUBLICATIONS

Picatinny Rails Home Page—AR-15/M16 Accessories, www.uws.com/picatinny/homepage.html, Jan. 10, 2006, pp. 1-4.
Sig P220 Adapter Rail, Picatinny, http://www.impactguns.com/store/S-220-PRA.html, Jan. 14, 2006, p. 1.
Rails & Mounts, Yankee Hill Machine Company, http://www.yankeehillmachine.com/store/rails.html, pp. 1-4.
Military Standard Dimensioning of Accessory Mounting Rail for Small Arms Weapons, Distribution Statement A, Feb. 3, 1995 pp. i-6.
Guns & Weapons, picture of cover page, Jan. 1995.

* cited by examiner

*Primary Examiner*—Bret Hayes
(74) *Attorney, Agent, or Firm*—Brian B. Shaw, Esq.; Thomas B. Ryan; Harter Secrest & Emery LLP

(57) ABSTRACT

A laser sight is embedded in a mounting rail otherwise used for attaching accessories to small arms discharge devices such as pistols or rifles. The mounting rail has a transverse profile that extends along an axis of the mounting rail for engaging mating features of the accessories. The laser sight is located at least partly within the transverse profile of the mounting rail and has a sighting axis that extends substantially parallel to the axis of the mounting rail.

16 Claims, 6 Drawing Sheets

FIREARM MOUNT WITH EMBEDDED LASER SIGHT

FIELD OF THE INVENTION

The invention relates to laser sights and their mountings on firearms or other small-arm dischargeable devices.

BACKGROUND OF THE INVENTION

Laser sights are particularly effective as sighting devices because the lasers illuminate spots on their targets and do not require users to align an eye with a sighting device, which can limit or obscure the user's view of the targets or their surroundings. When mounted on firearms, the laser sights emit beams that are directed along the expected flight paths of projectiles discharged from the firearms. However, the laser sights are necessarily mounted offset from the firearm barrels, so the laser beams extend generally parallel but offset from the initial flight paths of the projectiles. At close distances, the offset can result in a significant targeting error approximating the initial offset. Small angular adjustments of the laser sights can compensate for the offset at longer distances.

Particularly for handguns, which are intended for targeting over shorter distances, reducing the amount of this offset is desirable. My earlier U.S. Pat. No. 4,934,086 describes mounting a laser sight within the recoil spring tube of a firearm. The spring tube mounting locates the laser sight close to the barrel, protects the laser sight from exposure to external jarring, and avoids the encumbrance of an external accessory. However, such built-in mounting locations are not available in all handguns, so laser sights have also been externally mounted from both conventional rails and special adapters.

Laser sight modules have been mounted from conventional accessory mounts, such as Picatinny rails, in the same way that scopes and other accessories have been mounted on firearms. Typically, the laser sight modules include receptors for engaging the accessory mounts on the firearms. For example, dovetail-type receptors have been formed in laser sight modules for engaging Picatinny rails on the firearms. Laser sight modules have been mounted from different types of accessory mounts on the firearms, including from other types of rails, using mating receptors and have also been mounted on firearms using clamping devices or other forms of attachment for engaging firearm barrels, frames, or other components that are not otherwise intended as accessory mounts.

Often, it is desirable to mount the laser sights so that the sights can be removed and transferred between firearms, generally with as little adjustment as possible. Again, rails, particularly Picatinny-type rails, have been used for this purpose. The rails can be formed integral with the firearm frames or clamped or otherwise attached to the firearm barrels or frames.

Both the accessory mounts presented on firearms and the receptors for engaging them tend to offset the laser sights from the barrels. Alternative adapter structures used for attaching laser sights to firearm components that are not otherwise arranged as mountings also tend to offset the laser sights from firearm barrels. Among the accessory mounts, rail mounts, such as Picatinny rails, offset laser sights by the space occupied by the rails themselves and any attachments for fixing the rails to the firearm barrels or frames. In addition, the receptors used for engaging the rails can take up more space and displace the laser sights farther from firearm barrels. The known laser sight modules mounted in this way are also exposed to jarring and can encumber the handling or operation of firearms, particularly as the laser sights are mounted at increasing offset from firearm barrels.

SUMMARY OF INVENTION

The invention exploits space occupied by accessory mounts to construct sub-mountings for laser sights for such purposes as minimizing the offset of the laser sights from barrels, protecting the laser sights from exposure to jarring, and reducing encumbrances presented by the laser sights to the safe handling and operation of firearms. The accessory mounts, which present rails or other features for mounting accessories, can be integral parts of the firearms or can be attached as appendages to the firearms. The laser sights are preferably embedded within the accessory mounts without interfering with their function as primary or secondary mounts for attaching accessories to the firearms and also preferably without increasing the size of the accessory mounts.

In other words, the invention exploits space otherwise occupied by the accessory mounts to locate the laser sights closer to barrels, particularly within protected spaces having a reduced external profile with respect to the profile of laser sights mounted as conventional accessories. The accessory mounts within which the laser sights are embedded provide primary or secondary mounts for other accessories for appending or enhancing other functionalities. In addition to conventional firearms, the invention is applicable to other dischargeable devices including air guns, paintball launchers, crossbows, and other small arms that benefit from targeting.

One version of the invention as a new accessory mount for a small-arm dischargeable device includes a conventional dovetail rail for mounting an accessory. The conventional rail has tapered sidewalls that (a) extend along a longitudinal axis of the dovetail rail and (b) are spaced apart along an orthogonal transverse axis of the dovetail rail in positions for engaging mating sidewalls of a dovetail receptor formed in the accessory. However, in contrast to conventional accessory mounts, a laser sight is embedded in the dovetail rail in a position substantially aligned with the longitudinal axis of the dovetail rail and positioned along the transverse axis of the dovetail rail at least partly between the tapered sidewalls.

The laser sight is preferably centered between the tapered sidewalls along the transverse axis of the dovetail rail. The tapered sidewalls of the dovetail rail can have opposing V-shaped profiles with apices aligned along the transverse axis. The laser sight preferably includes a beam generator and a collimating optic aligned by a common housing.

The tapered sidewalls preferably overhang opposite sides of a pedestal that supports the tapered sidewalls. The housing of the laser sight can be entirely embedded in the space between the tapered sidewalls of the rail or can be embedded within a larger space that includes both the space between the sidewalls and a space between the sides of the pedestal.

The dovetail rail can be formed integrally with the dischargeable device or can be attached to the dischargeable device by a clamp or other fastener. The dovetail rail can also be formed as a part of an adapter that presents the dovetail rail as a secondary mount and has a receptor for engaging a primary mount on the dischargeable device. For example, the adapter receptor can be formed as a dovetail receptor for engaging a dovetail rail attached to the dischargeable device as the primary mount.

An outer land surface of the dovetail rail preferably interconnects the tapered sidewalls. A battery compartment for supplying power to the laser sight can be formed in the dovetail rail through the outer land surface. A repositionable cover for the battery compartment can form a portion of the outer land surface of the dovetail rail.

Another version of the invention modifies a Picatinny-type rail for mounting accessories to a small-arm dischargeable device to incorporate a laser sight that is at least partially embedded in a portion of the Picatinny-type rail having a T-shaped profile for engaging corresponding profile features of the accessories. The T-shaped profile of the Picatinny-type rail includes a pedestal supporting an overhanging platform having relatively inclined sidewalls for engaging the accessories. The T-shaped profile extends along a longitudinal axis of the Picatinny-type rail. The laser sight emits a collimated beam of light along an optical axis that is substantially aligned with the longitudinal axis of the Picatinny-type rail within the T-shaped profile of the Picatinny-type rail. A battery compartment can be formed in the overhanging platform through an outer land surface that extends between the relatively inclined sidewalls of the platform. A repositionable cover for the battery compartment preferably forms a portion of the outer land surface.

Another version of the invention as an adapter system for mounting an accessory to a small-arm dischargeable device includes an adapter body having a receptor and a mounting rail supported from the receptor. The mounting rail has a transverse profile extending along an axis of the mounting rail for engaging mating features of the accessory. The receptor is adaptable to the dischargeable device for aligning the axis of the mounting rail substantially parallel with a discharge axis of the dischargeable device. A light-emitting sighting device is located at least partly within the transverse profile of the mounting rail and has a sighting axis that extends substantially parallel to the axis of the mounting rail.

Preferably, the transverse profile is formed in part by relatively inclined sidewalls of the mounting rail, and the light-emitting sighting device is centered between the relatively inclined sidewalls of the mounting rail. A battery compartment for powering the light-emitting sighting device can also be formed in the mounting rail. A cover for the battery compartment preferably encloses the battery compartment within the mounting rail.

Preferably, the transverse profile is formed in part by an outer land surface, and the outer land surface of the mounting rail includes a set of recoil grooves that extend substantially perpendicular to the axis of the mounting rail. The receptor can be formed integrally with the dischargeable device or can be formed as a clamp for attaching directly to the dischargeable device or for attaching to a mounting rail that is attached to the dischargeable device. For example, the clamp can include mating features for engaging a barrel or frame of the dischargeable device. Alternatively the clamp can include mating features in the form of a receptor for engaging a mounting rail of the dischargeable device.

BRIEF DESCRIPTION OF THE DRAWING FIGURES

DETAILED DESCRIPTION

Figure 1:
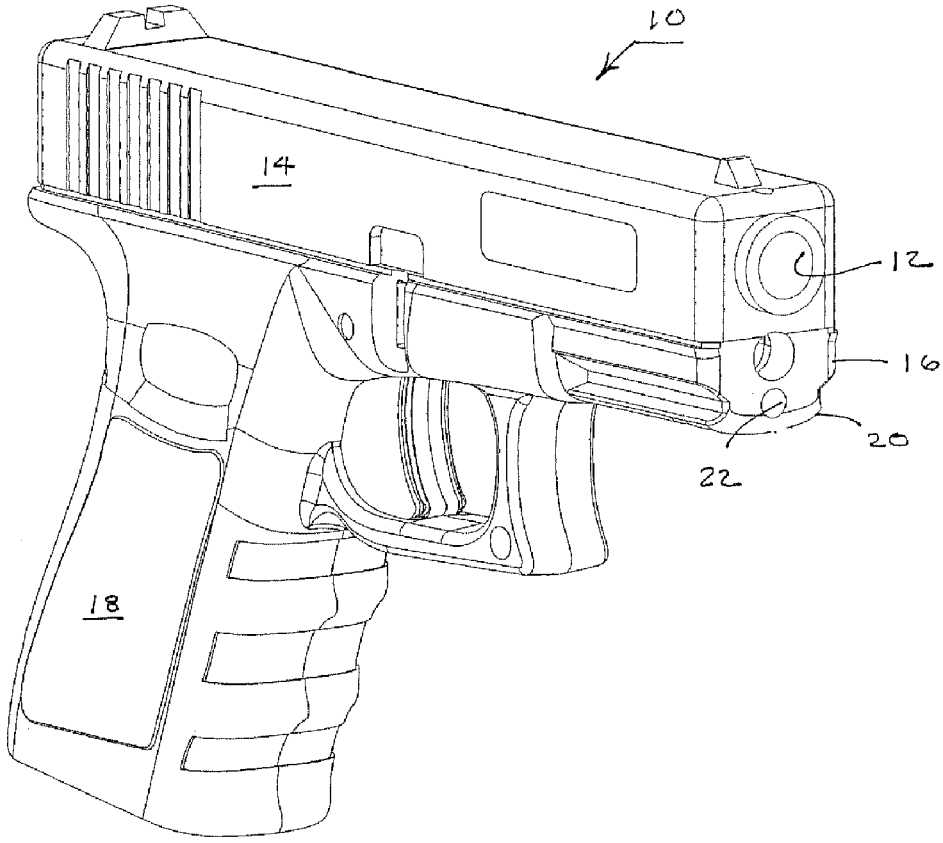
FIG. 1 is a perspective view of a pistol having a laser sight embedded in a mounting rail formed integrally with the pistol's receiver.

A conventional pistol 10 depicted in FIG. 1 includes the usual features of a barrel 12, a slide 14, and a receiver (or frame) 16 with an integral grip 18 as well as an accessory mount formed in the receiver 16 as a dovetail rail 20. Various accessories can be mounted from the dovetail rail 20 including tactical lights, laser sight modules, and supporting devices. However, the invention as shown in FIG. 1 modifies the dovetail rail 20 to house a laser sight 22.

Figure 2:
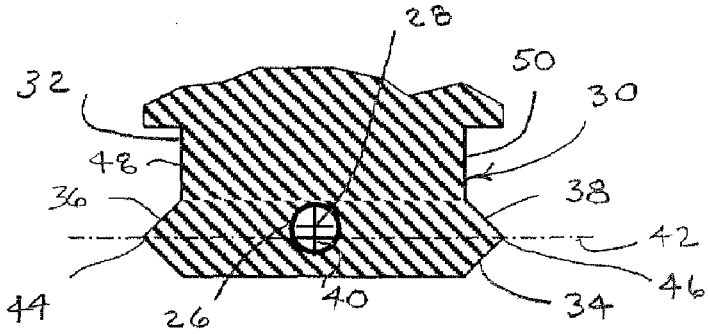
FIG. 2 is an enlarged cross-sectional end view of a Picatinny rail in transverse profile showing a laser sight embedded in a platform portion of the mounting rail.
Figure 3:
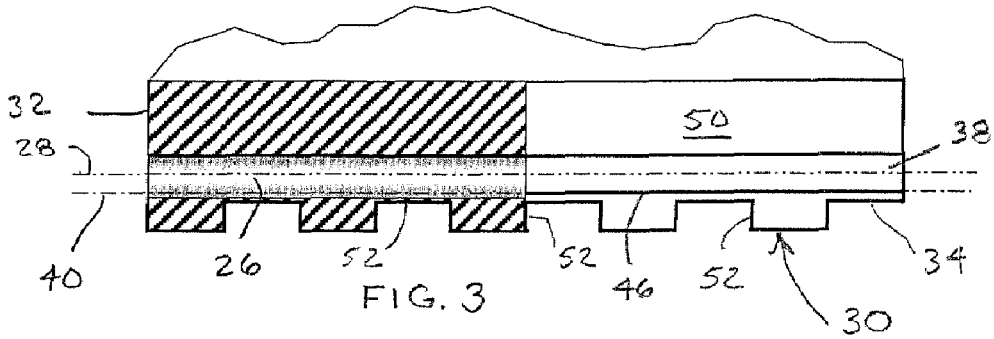
FIG. 3 is an enlarged partly cutaway portion of the mounting rail showing the embedded laser sight aligned substantially parallel to a longitudinal axis of the mounting rail.

FIGS. 2 and 3 depict enlarged views of an alternative dovetail rail 30 within which a laser sight 26 is similarly housed. The dovetail rail 30 has the conventional configuration of a Picatinny rail having a T-shaped profile. A pedestal 32 (forming the base of the T) supports an overhanging platform 34 (forming the crossbar of the T) that has tapered sidewalls 36 and 38 extending without interruption along a longitudinal axis 40 of the dovetail rail 30. The longitudinal axis 40 is generally aligned with a barrel of a firearm. The tapered sidewalls 36 and 38, which are spaced apart along an orthogonal transverse axis 42 of the dovetail rail 30, are formed as compound surfaces having opposing V-shaped profiles with apices 44 and 46 aligned along the transverse axis 42. The V-shaped profiles of the tapered sidewalls 36 and 38 are engageable by mating surfaces of receptors (not shown) for attaching accessories to the dovetail rail 30. Sides 48 and 50 of the pedestal 32 provide clearance for engaging the receptors.

The laser sight 26, which is embedded within the platform 34 of the dovetail rail 30, occupies a space between the tapered sidewalls 36 and 38 of the platform 34 that would otherwise form a solid part of the dovetail rail 30 or a recess within the dovetail rail 30. The laser sight 26 has an optical axis 28 that is substantially aligned with the longitudinal axis 40 of the dovetail rail 30, but is also preferably adjustable to secure a desired alignment with the discharge axis of the firearm or other discharge device on which the laser sight 26 is mounted. In addition, the laser sight 26 is preferably centered between the tapered sidewalls 36 and 38 along the transverse axis 42. The dovetail rail 30 also includes a set of recoil grooves 52 that cross the dovetail rail 30 in the direction of the transverse axis 42. The laser sight 26 is preferably mounted beneath the recoil grooves 52 to limit environmental exposure or to avoid interfering with any intended functions for the recoil grooves 52.

Figure 4:
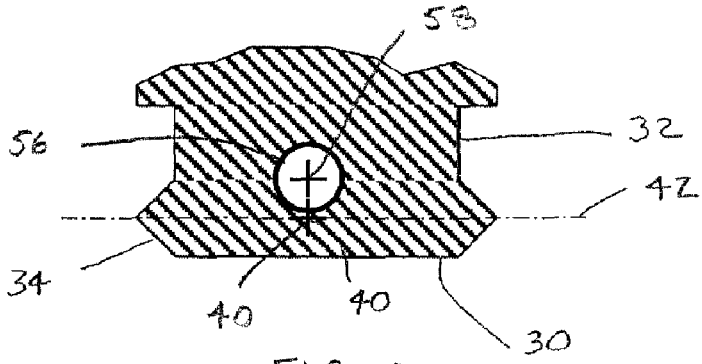
FIG. 4 is an enlarged cross-sectional end view of the same Picatinny rail in a transverse profile showing a larger laser sight embedded in parts of both the platform portion of the mounting rail and a pedestal portion of the mounting rail.
Figure 5:
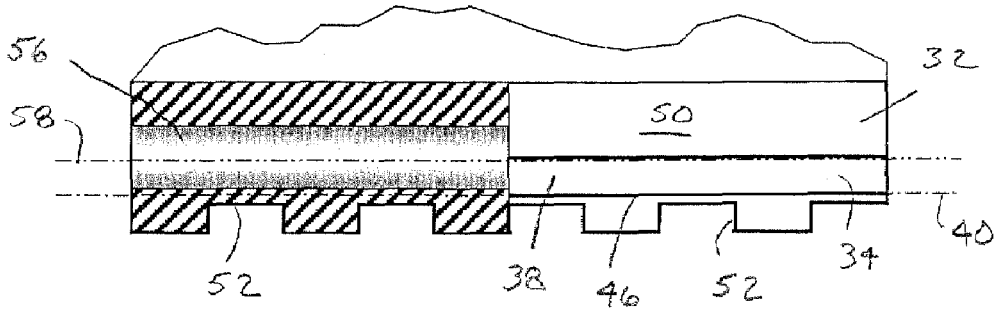
FIG. 5 is an enlarged partly cutaway portion of the same mounting rail showing the embedded larger laser sight aligned substantially parallel to a longitudinal axis of the mounting rail.
Figure 7:
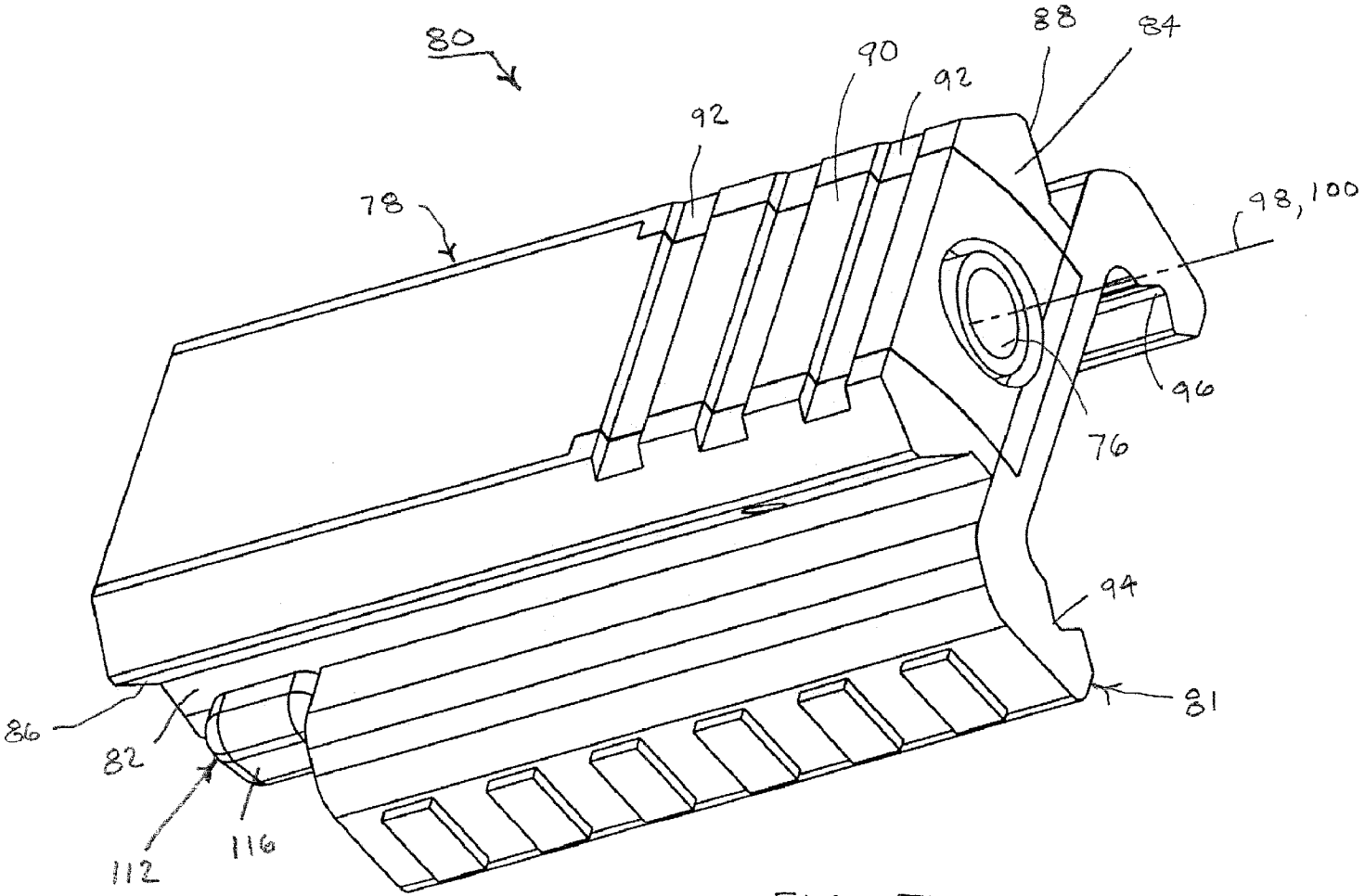
FIG. 7 is an enlarged perspective view of an adapter having a mounting rail and a receptor with a laser sight embedded within the mounting rail.
Figure 8:
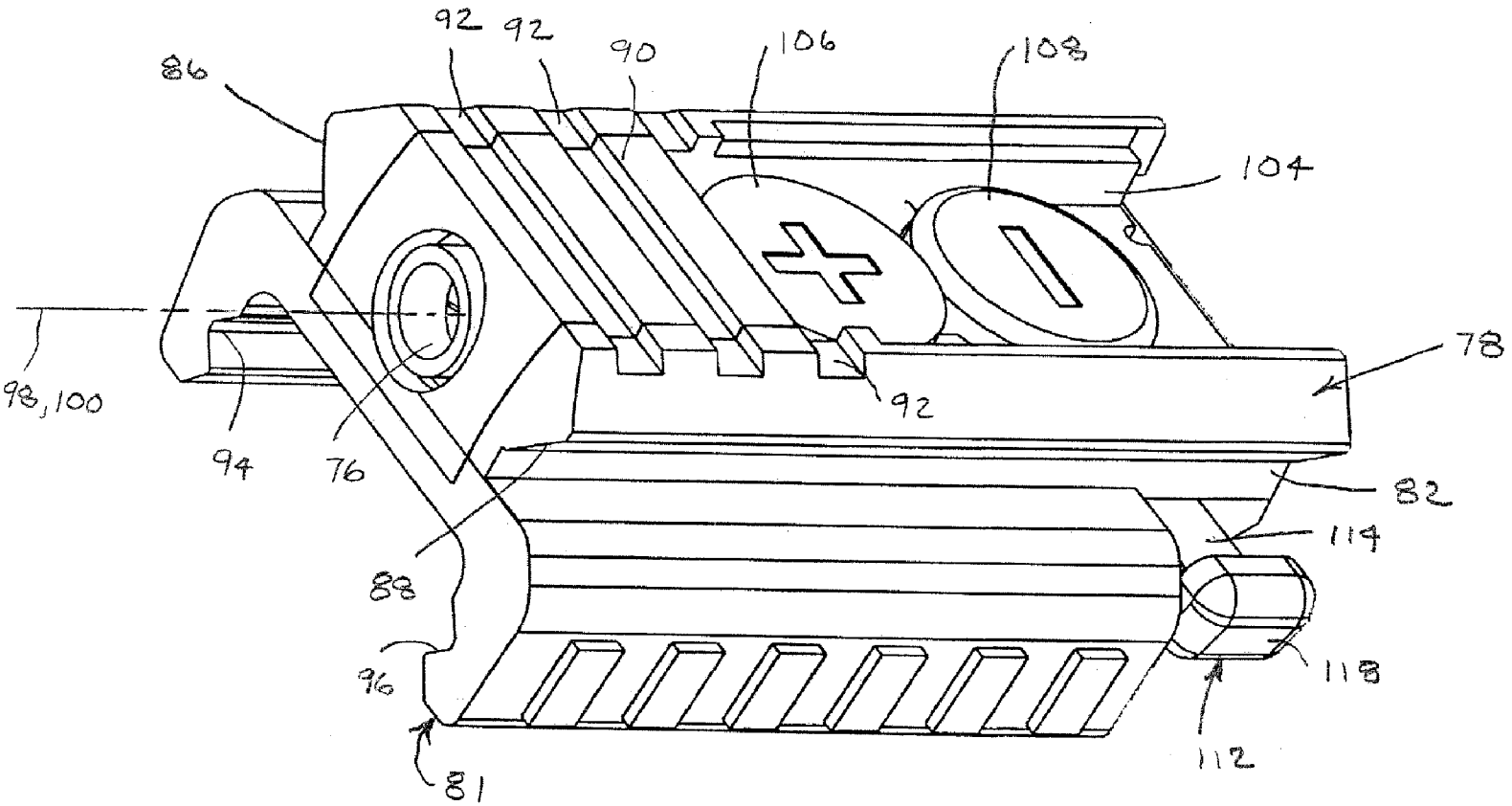
FIG. 8 is an opposite side perspective view of the adapter showing a battery compartment formed in the mounting rail for powering the laser sight.
Figure 9:
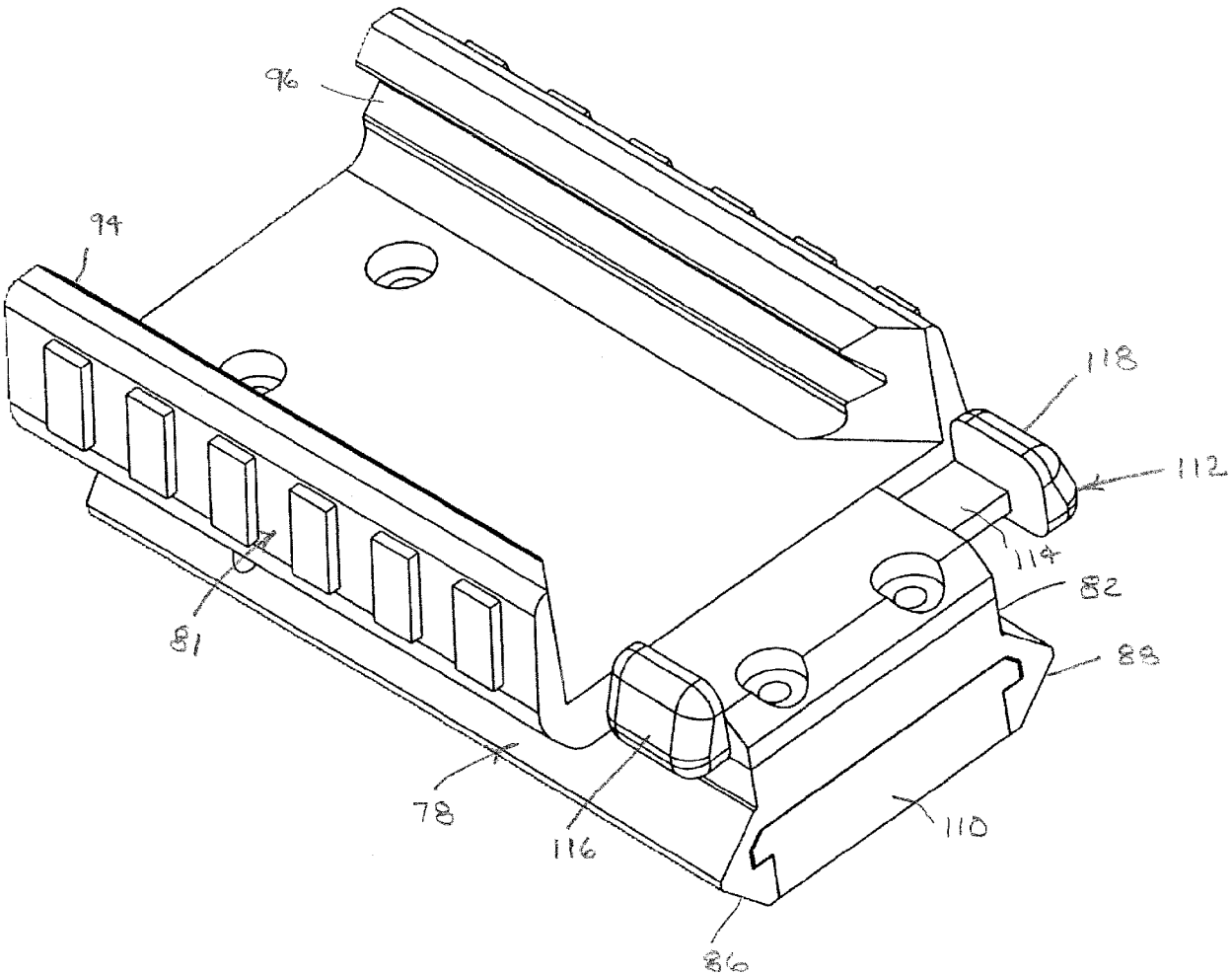
FIG. 9 is an inverted perspective view of the adapter showing details of the receptor and a toggle switch for turning the laser sight on and off.
Figure 10:
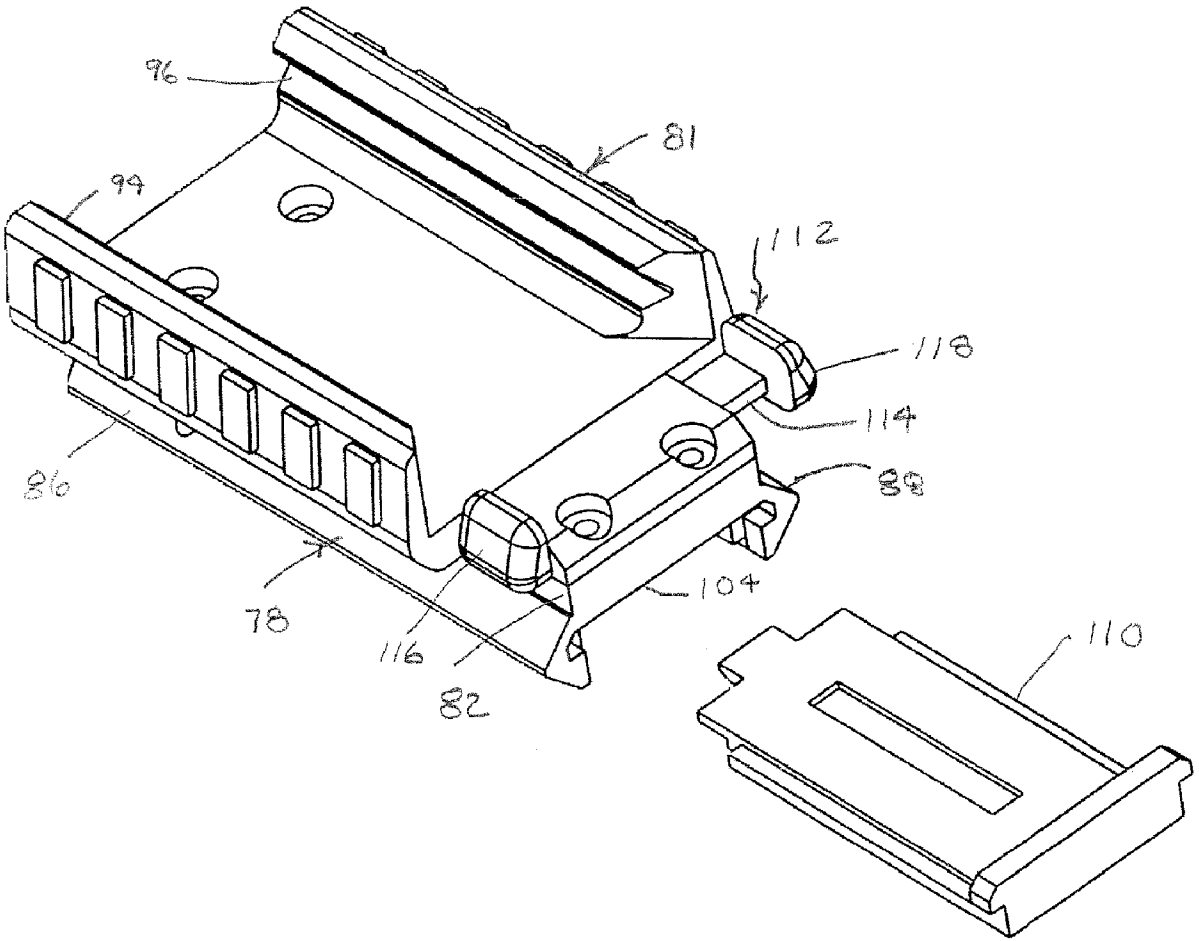
FIG. 10 is another inverted perspective view showing a cover withdrawn from the battery compartment.

FIGS. 4 and 5 show a different location for embedding a larger laser sight 56 within the same Picatinny-type dovetail rail 30. Instead of embedding the laser sight 56 entirely within the platform 34 of the dovetail rail 30 as depicted in FIGS. 2 and 3, the laser sight 56 of FIGS. 4 and 5 is embedded partly within the platform 34 and partly within the pedestal 32. The additional space provided by the platform 34 allows the larger laser sight 56 to be embedded within the dovetail rail 30 without protruding into the recoil grooves 52.

The laser sight 56 has an optical axis 58 that is substantially aligned with the longitudinal axis 40 and is also preferably adjustable for perfecting the alignment of the optical axis 58 with the expected flight path of a projectile or other emission discharged from a small-arm device on which the laser sight 56 is mounted. The laser sight 56 is also centered along the transverse axis 42 between the sidewalls 36 and 38 of the platform 34.

Thus, space within the entire T-shaped profile of the dovetail rail 30 can be used for embedding a laser sight such as the laser sights 26 and 56. This allows the laser sights 26 and 56 to be mounted within a protected environ closer to the discharge axes of small arms without taking up additional space or creating unnecessary encumbrances. While the invention is expected to be especially useful as a modification to Picatinny rails, other mounting rails, particularly those of the Picatinny type that differ in size or shape but present a comparable dovetail mounting system with transverse space sufficient for embedding a laser sight, can also benefit from the invention.

Figure 6:
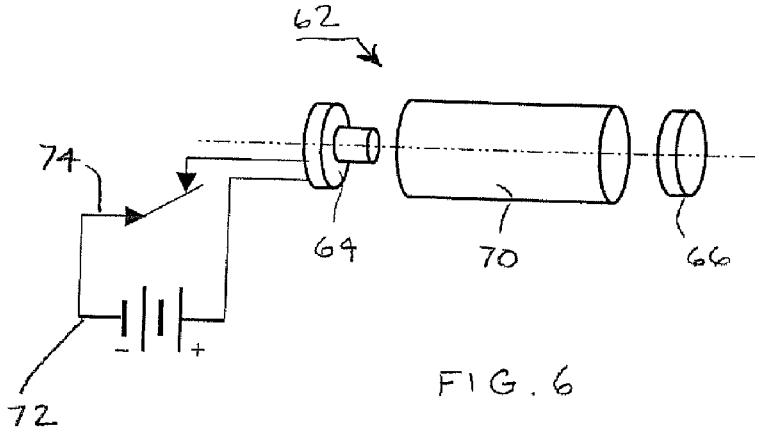
FIG. 6 is an enlarged partly exploded view of a laser sight assembly within a common tubular housing and connected to a portable power supply.

As shown in FIG. 6, a typical laser sight 62 intended for purposes of the invention includes a laser diode 64 and a collimating lens 66 aligned along a common optical axis 68 within a common housing 70. Additional components can also be included within the housing including control circuitry (not shown) for cycling the laser diode 64 on and off to save power and adjustment features for the collimating lens for aligning the laser sight 52 as desired. An onboard power supply 72 supplies power to the laser diode 36 through a circuit interrupted by a switch 74. The power supply 72, which is preferably in the form of one or more batteries, can be located within an extension of the common housing 70 or can be located elsewhere in the dovetail rail or within the small-arm discharge device, such as within the grip of a firearm. The switch 74 can also be mounted in the dovetail rail or elsewhere in the small-arm discharge device. A more detailed example of a laser sight that can be assembled within a common housing is described in my U.S. Pat. No. 5,509,226, which is hereby incorporated by reference.

Another embodiment of the invention depicted in FIGS. 7-10 mounts a laser sight 76 within a mounting rail 78 of an adapter 80 that presents the mounting rail 78 as a secondary mount. The adapter 80 also includes a receptor 81 for engaging a primary mounting rail (not shown), which can be attached to or formed integrally with a small-arm discharge device.

The secondary mounting rail 78 and the receptor 81 include the mating features of dovetail joints, preferably of the Picatinny type. For example, the secondary mounting rail 78 has a T-shaped profile with a pedestal 82 supporting an overhanging platform 84. Sidewalls 86 and 88 of the platform 84 have compound surfaces with opposing V-shapes for engaging similarly shaped sidewalls in an accessory receptor (not shown). An outer land surface 90 containing a set of recoil grooves 92 spans the two sidewalls 86 and 88.

The adapter receptor 81 from which the pedestal 82 projects also includes a pair of sidewalls 94 and 96 having a V-shaped configuration for receiving mating sidewalls of a primary mounting rail (not shown), such as may be formed integrally with or as an attachment to a small-arm discharge device. Clamps, including setscrews or other fastening structures, can be incorporated into the receptor 81 for securing the adapter 80 to a primary mounting rail.

The laser sight 76 is embedded in the secondary mounting rail 78 within a space otherwise occupied by the pedestal 82 and overhanging platform 84, which together form the T-shaped profile of the mounting rail 78. An optical axis 98 of the laser sight 76 is substantially aligned with a longitudinal axis 100 or the mounting rail 78, but is preferably adjustable for calibrating the laser sight. At least part of the laser sight 76 is embedded between the tapered sidewalls 94 and 96 of the platform 94 and a remaining part of the laser sight 76 is embedded in the pedestal 92 of the mounting rail 78. In addition, the laser sight 76 is centered between the tapered sidewalls 94 and 96.

A battery compartment 104 is formed in the mounting rail 78 through the outer land surface 90. Two button-type batteries 106 and 108 are shown within the battery compartment 104 for powering the laser sight 76. A slide-on cover 110 for the battery compartment 104 forms a part of the outer land surface 90.

A toggle switch 112 is formed through the mounting rail 78, particularly within the pedestal 92 for electrically connecting and disconnecting the laser sight 76 to the batteries 106 and 108. The toggle switch 112 has a switch arm 114 that is translatable between middle position at which the laser sight 76 is disconnected and either of two end positions at which the laser sight 76 is connected for powering the laser sight. Knobs 116 and 118 at opposite ends of the arm 114 provide handles for manually translating the switch and also provide stops for limiting the translation of the toggle switch 112 to between the off and on positions.

Thus, in addition to embedding the laser sight 76 in the mounting rail 78 of the adapter 80, the battery compartment 104 is formed in the mounting rail 78 for powering the laser sight 76 and a switch 112 is formed through the mounting rail 78 for turning the laser sight 76 both on and off. Together, the laser sight 76, battery compartment 104, and the switch 112 form an entirely self-contained laser module within space otherwise occupied by the mounting rail 78 of the adapter 80, which can be transferred by way of the adapter receptor 81 between small-arm discharge devices.

The receptor 81 can be arranged as a mate to the mounting rail 78, such as by forming both the receptor 81 and the mounting rail 78 according to conventional Picatinny specifications, or the receptor 81 can be arrange to mate with a different style mounting rail so that the secondary mounting rail 78 projecting from the adapter 80 is different from the primary mounting rail intended for engagement by the receptor 81 formed within the adapter 80. In addition to presenting a different choice of mounting rail for attaching accessories, the adapter 80 can be used as a riser for deliberately offsetting other accessories. Either way, the laser sight 76 is embedded in the secondary mounting rail in a protected fashion without requiring additional space beyond the space otherwise required for carrying out the adaptor's other functions.

Alternatively, the receptor 81 could be arranged as a clamp for engaging other components of the small-arm discharge device, such as a barrel, ordinarily not intended for mounting accessories. The receptor could also be formed integrally with the receiver or frame of small-arm discharge devices, and the mounting rail of such an integral structure could be modified to incorporate, in addition to laser sights, battery compartments or switches for operating the laser sights. Conversely, adapters with mounting rails modified to incorporate laser sights can be electrically coupled to the small-arm discharge devices or to accessories of the small-arm discharge devices to obtain power or switch control.

What is claimed is:

1. An accessory mount for a small-arm dischargeable device comprising a dovetail rail for mounting an accessory, tapered sidewalls of the dovetail rail extending along a longitudinal axis of the dovetail rail and being spaced apart along an orthogonal transverse axis of the dovetail rail in positions for engaging mating sidewalls of a dovetail receptor formed in the accessory, a pedestal of the dovetail rail having opposite sides that extend along the longitudinal axis adjacent to the tapered sidewalls of the dovetail rail in a form that provides clearance for the mating sidewalls of the dovetail receptor to engage the tapered sidewalls of the dovetail rail, and a laser sight embedded in the dovetail rail in a position substantially aligned with the longitudinal axis of the dovetail rail and positioned directly between at least one of (a) the tapered sidewalls and (b) the sides of the pedestal.

2. The accessory mount of claim 1 in which the laser sight is centered directly between the tapered sidewalls of the dovetail rail.

3. The accessory mount of claim 2 in which the tapered sidewalls of the dovetail rail have opposing V-shaped profiles with apices aligned along the transverse axis.

4. The accessory mount of claim 1 in which the laser sight includes a beam generator and a collimating optic aligned by a common housing.

5. An accessory mount for a small-arm dischargeable device comprising a dovetail rail for mounting an accessory, tapered sidewalls of the dovetail rail extending along a longitudinal axis of the dovetail rail and being spaced apart along an orthogonal transverse axis of the dovetail rail in positions for engaging mating sidewalls of a dovetail receptor formed in the accessory, a laser sight embedded in the dovetail rail in a position substantially aligned with the longitudinal axis of the dovetail rail and positioned along the transverse axis of the dovetail rail at least partly between the tapered sidewalls, the laser sight including a beam generator and a collimating optic aligned by a common housing, and the tapered sidewalls overhanging opposite sides of a pedestal that supports the tapered sidewalls.

6. The accessory mount of claim 5 in which the common housing is embedded within a space that includes both a space directly between the tapered sidewalls and a space directly between the sides of the pedestal.

7. The accessory mount of claim 6 in which the common housing is entirely embedded within the space directly between the tapered sidewalls.

8. The accessory mount of claim 6 in which a first portion of the common housing is embedded within the space directly between the tapered sidewalls and a second portion of the common housing is embedded in the space directly between the sides of the pedestal.

9. The accessory mount of claim 1 in which the dovetail rail is formed integrally with the small-arm dischargeable device.

10. The accessory mount of claim 1 further comprising a clamp for attaching the dovetail rail to the small-arm dischargeable device.

11. The accessory mount of claim 10 in which the clamp includes features for engaging a barrel of the small-arm dischargeable device.

12. An accessory mount for a small-arm dischargeable device comprising a dovetail rail for mounting an accessory, tapered sidewalls of the dovetail rail extending along a longitudinal axis of the dovetail rail and being spaced apart along an orthogonal transverse axis of the dovetail rail in positions for engaging mating sidewalls of a dovetail receptor formed in the accessory, and a laser sight embedded in the dovetail rail in a position substantially aligned with the longitudinal axis of the dovetail rail and positioned along the transverse axis of the dovetail rail at least partly between the tapered sidewalls, wherein the dovetail rail is formed as a part of an adapter that presents the dovetail rail as a secondary mount and has a receptor for engaging a primary mount on the dischargeable device.

13. The accessory mount of claim 12 in which the adapter receptor is a dovetail receptor for engaging a dovetail rail attached to the dischargeable device as the primary mount.

14. The accessory mount of claim 1 in which the dovetail rail is formed as a part of an adapter that presents the dovetail rail as a secondary mount and has a receptor for engaging a primary mount on the dischargeable device.

15. An accessory mount for a small-arm dischargeable device comprising a dovetail rail for mounting an accessory, tapered sidewalls of the dovetail rail extending along a longitudinal axis of the dovetail rail and being spaced apart along an orthogonal transverse axis of the dovetail rail in positions for engaging mating sidewalls of a dovetail receptor formed in the accessory, and a laser sight embedded in the dovetail rail in a position substantially aligned with the longitudinal axis of the dovetail rail and positioned along the transverse axis of the dovetail rail at least partly between the tapered sidewalls, wherein an outer land surface of the dovetail rail interconnects the tapered sidewalls, and a battery compartment for supplying power to the laser sight is formed in the dovetail rail through the outer land surface.

16. The accessory mount of claim 15 in which a repositionable cover for the battery compartment forms a portion of the outer land surface of the dovetail rail.

* * * * *